US006272685B1

(12) United States Patent
Kumar

(10) Patent No.: US 6,272,685 B1
(45) Date of Patent: Aug. 14, 2001

(54) PATIENT'S EXAMINATION CLOTHING

(76) Inventor: Rekha Anand Kumar, 551 Grove St., Clifton, NJ (US) 07013

( * ) Notice: Subject to any disclaimer, the term of this patent is extended or adjusted under 35 U.S.C. 154(b) by 0 days.

(21) Appl. No.: 09/697,983

(22) Filed: Oct. 26, 2000

(51) Int. Cl.[7] ..... A41D 13/00
(52) U.S. Cl. ..... 2/114; 2/69
(58) Field of Search ..... 2/114, 104–106, 2/69, 80, 83, 85, 93, 95, 78.1, 78.2, 46, 51, 50, 49.1

(56) References Cited

U.S. PATENT DOCUMENTS

| | | | | |
|---|---|---|---|---|
| D. 374,113 | | 10/1996 | Console . | |
| 1,582,385 | * | 4/1926 | Dauphinais | 2/114 |
| 2,818,573 | * | 1/1958 | O'Donnell | 2/114 |
| 3,464,063 | * | 9/1969 | Hoegerman | 2/114 |
| 3,803,640 | * | 4/1974 | Ericson | 2/114 |
| 4,434,511 | * | 3/1984 | Weiser | 2/114 |
| 4,570,268 | | 2/1986 | Freeman . | |
| 4,578,825 | * | 4/1986 | Vote | 2/114 |
| 4,754,500 | * | 7/1988 | Brucato et al. | 2/105 |
| 4,759,083 | * | 7/1988 | Belcher | 2/114 |
| 4,837,863 | * | 6/1989 | Van Scoy-Mosher | 2/114 |
| 4,920,578 | | 5/1990 | Janzen et al. . | |
| 4,964,173 | | 10/1990 | Gordon et al. . | |
| 5,361,414 | * | 11/1994 | Smith | 2/114 |
| 5,367,710 | | 11/1994 | Karmin . | |
| 5,454,119 | * | 10/1995 | Thomm | 2/114 |
| 5,694,643 | * | 12/1997 | Fujiwara | 2/69 |

* cited by examiner

*Primary Examiner*—Gloria M. Hale

(57) ABSTRACT

A patient's examination clothing for allowing the patient to be examined while being appropriately covered. The patient's examination clothing includes a gown having a front, a back, an upper portion, and a lower portion; and also includes a bib member being attached to the front and the upper portion of the gown; and further includes an apron member being attached to the back and to the lower portion of the gown; and also includes a plurality of fastening members being attached to the gown and the bib member.

11 Claims, 2 Drawing Sheets

PATIENT'S EXAMINATION CLOTHING

BACKGROUND OF THE INVENTION

1. Field of the Invention

The present invention relates to a privacy gown and more particularly pertains to a new patient's examination clothing for allowing the patient to be examined while being appropriately covered.

2. Description of the Prior Art

The use of a privacy gown is known in the prior art. More specifically, a privacy gown heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,964,173; U.S. Pat. No. 4,759,083; U.S. Pat. No. 5,367,710; U.S. Pat. No. 4,570,268; U.S. Pat. No. 4,920,578; and U.S. Pat. No. Des. 374,113.

While these devices fulfill their respective, particular objectives and requirements, the aforementioned patents do not disclose a new patient's examination clothing. The inventive device includes a gown having a front, a back, an upper portion, and a lower portion; and also includes a bib member being attached to the front and the upper portion of the gown; and further includes an apron member being attached to the back and to the lower portion of the gown; and also includes a plurality of fastening members being attached to the gown and the bib member.

In these respects, the patient's examination clothing according to the present invention substantially departs from the conventional concepts and designs of the prior art, and in so doing provides an apparatus primarily developed for the purpose of allowing the patient to be examined while being appropriately covered.

SUMMARY OF THE INVENTION

In view of the foregoing disadvantages inherent in the known types of privacy gown now present in the prior art, the present invention provides a new patient's examination clothing construction wherein the same can be utilized for allowing the patient to be examined while being appropriately covered.

The general purpose of the present invention, which will be described subsequently in greater detail, is to provide a new patient's examination clothing which has many of the advantages of the privacy gown mentioned heretofore and many novel features that result in a new patient's examination clothing which is not anticipated, rendered obvious, suggested, or even implied by any of the prior art privacy gown, either alone or in any combination thereof.

To attain this, the present invention generally comprises a gown having a front, a back, an upper portion, and a lower portion; and also includes a bib member being attached to the front and the upper portion of the gown; and further includes an apron member being attached to the back and to the lower portion of the gown; and also includes a plurality of fastening members being attached to the gown and the bib member.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new patient's examination clothing which has many of the advantages of the privacy gown mentioned heretofore and many novel features that result in a new patient's examination clothing which is not anticipated, rendered obvious, suggested, or even implied by any of the prior art privacy gown, either alone or in any combination thereof.

It is another object of the present invention to provide a new patient's examination clothing which may be easily and efficiently manufactured and marketed.

It is a further object of the present invention to provide a new patient's examination clothing which is of a durable and reliable construction.

An even further object of the present invention is to provide a new patient's examination clothing which is susceptible of a low cost of manufacture with regard to both materials and labor, and which accordingly is then susceptible of low prices of sale to the consuming public, thereby making such patient's examination clothing economically available to the buying public.

Still yet another object of the present invention is to provide a new patient's examination clothing which provides in the apparatuses and methods of the prior art some of the advantages thereof, while simultaneously overcoming some of the disadvantages normally associated therewith.

Still another object of the present invention is to provide a new patient's examination clothing for allowing the patient to be examined while being appropriately covered.

Yet another object of the present invention is to provide a new patient's examination clothing which includes a gown having a front, a back, an upper portion, and a lower portion; and also includes a bib member being attached to the front and the upper portion of the gown; and further includes an apron member being attached to the back and to the lower portion of the gown; and also includes a plurality of fastening members being attached to the gown and the bib member.

Still yet another object of the present invention is to provide a new patient's examination clothing that eliminates the embarrassment that patients commonly exhibit when wearing skimpy gowns.

Even still another object of the present invention is to provide a new patient's examination clothing that allows the examiner to do one's job of examining the patient without the patient having to embarrassingly expose oneself to the examiner.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
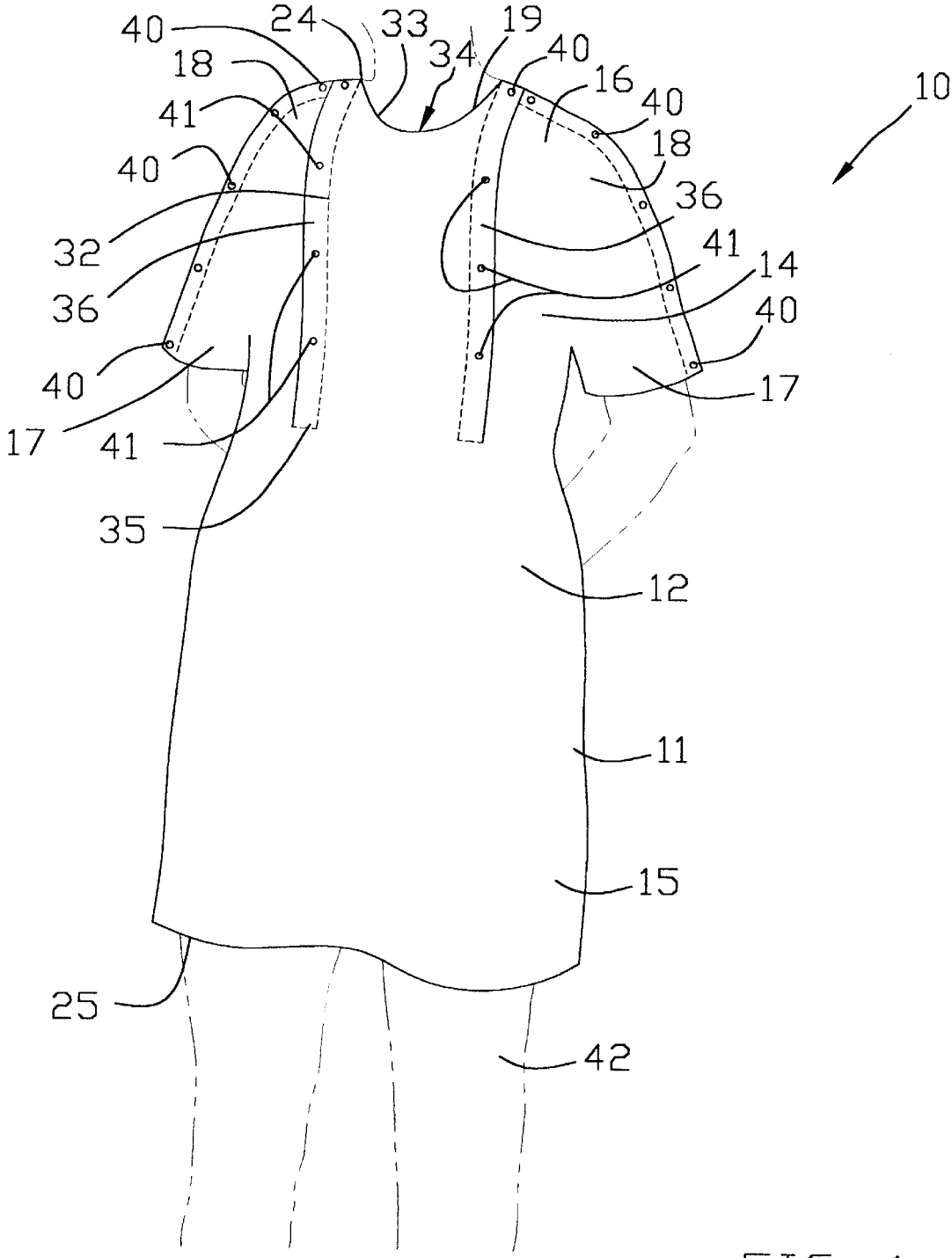
FIG. 1 is a perspective view of a new patient's examination clothing according to the present invention and shown in use.
Figure 3:
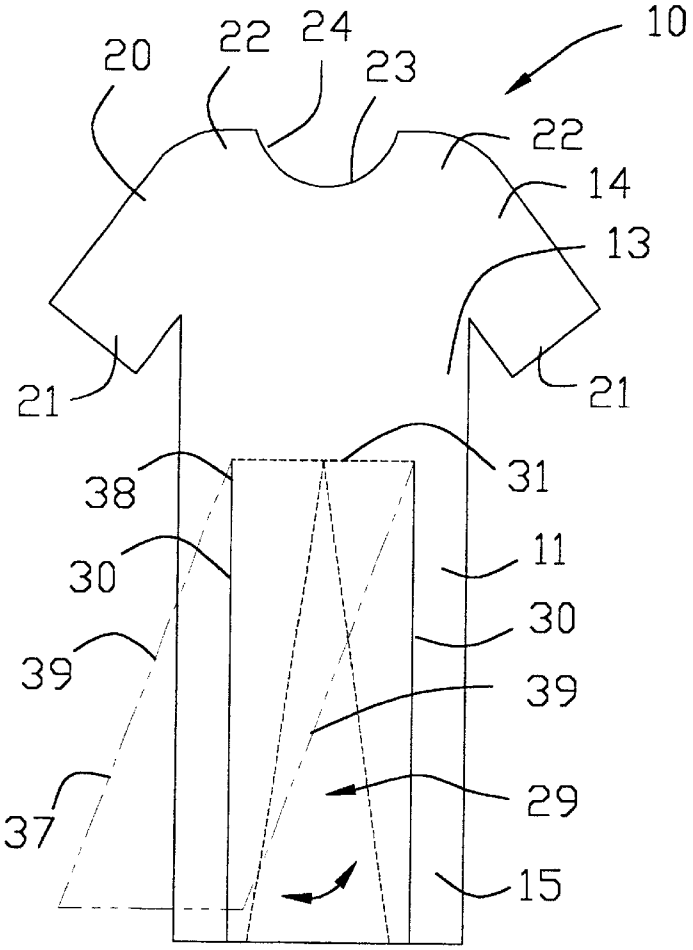
FIG. 3 is a rear elevational view of the present invention.
Figure 2:
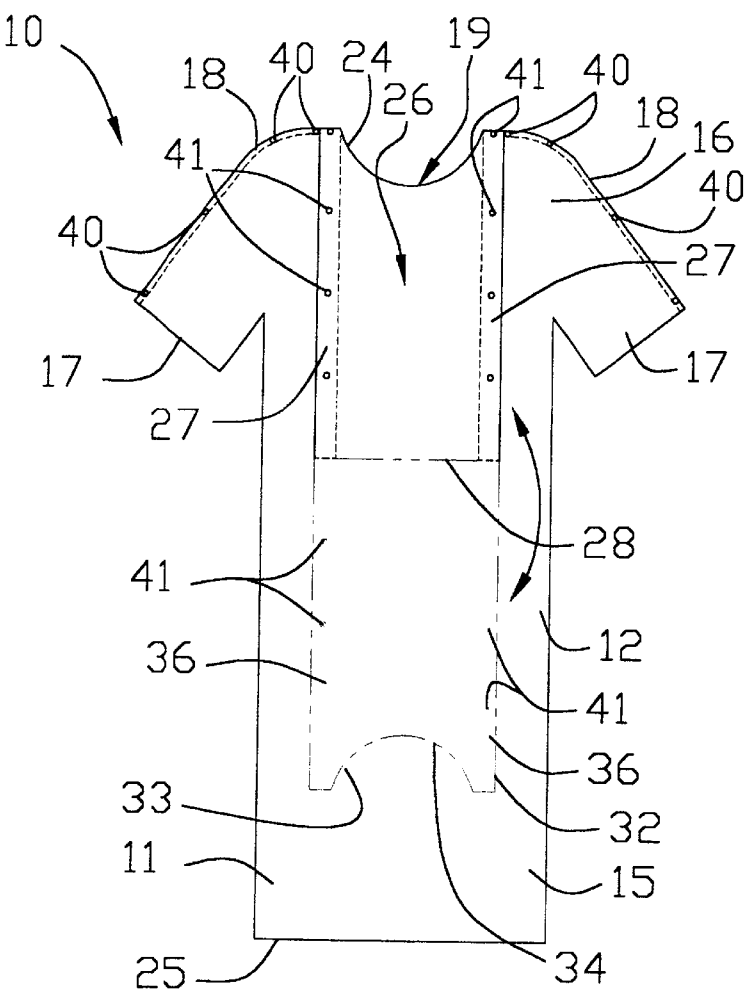
FIG. 2 is a front elevational view of the present invention.

With reference now to the drawings, and in particular to FIGS. 1 through 3 thereof, a new patient's examination clothing embodying the principles and concepts of the present invention and generally designated by the reference numeral 10 will be described.

As best illustrated in FIGS. 1 through 3, the patient's examination clothing 10 generally comprises a gown 11 having a front 12, a back 13, an upper portion 14, and a lower portion 15. The gown 11 also includes an upper back portion 20 and an upper front portion 16 being removably fastened to one another. Each of the upper back and front portions 16,20 includes shoulder portions 18,22, sleeve portions 17,21 and a neck portion 19,23. The gown further includes an opening 26 disposed through the upper front portion 16 and through a top edge 24 thereof, and also includes an opening 29 disposed through the lower back portion 20 and through a bottom edge 25 thereof. The gown 11 is adapted to extend below a user's crotch and buttock 42 with the gown 11 having a length of approximately 39 inches.

A bib member 32 is conventionally attached to the front 12 and the upper portion 14 of the gown 11. The bib member 11 includes a bottom edge 35 which is securely and conventionally attached along a bottom edge 28 defining the opening 26 disposed through the upper front portion 16 of the gown 11, and also includes side edge portions 36 which removably overlap side edge portions 27 defining the opening 26 disposed through the upper front portion 16 of the gown 11. The bib member 32 further includes a top edge 33 having a recessed portion 34 centrally disposed in the top edge 33 thereof. The recessed portion 34 is adapted to accommodate a user's neck.

An apron member 37 is conventionally attached to the back 13 and the lower portion 15 of the gown 11. The apron member 37 includes a top edge 38 which is securely and conventionally attached along a top edge 31 defining the opening 29 disposed through the lower back portion 13,15 of the gown 11, and also includes side edge portions 39 which removably overlap side edge portions 30 defining the opening 29 disposed through the lower back portion 13,15 of the gown 11. The top edge 38 of the apron member 37 is securely and conventionally attached at a waist line of the gown 11.

A plurality of fastening members 40,41 are conventionally attached to the gown 11 and the bib member 32. The fastening members include first fastening members 40 which are generally snaps and which are securely and conventionally disposed along edges of the sleeve portions 17,21 and the shoulder portions 18,22 of the upper front and back portions 16,20 for securely and removably fastening respective sleeve portions 17,21 together and respective shoulder portions 18,22 together. The fastening members 40,41 also include second fastening members 41 which are also snaps and which are securely and conventionally disposed along the side edge portions 27 defining the opening 26 disposed through the upper front portion 14,16 of the gown 11, and which are securely and conventionally disposed along the side edge portions 36 of a back of the bib member 32.

In use, the user 42 slips the gown about one's body and fastens the fastening members 40,41 together, and when needed, the user 42 unfastens the first fastening members 41, and also when needed, the examiner can remove the apron member 37 for examination purposes.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A patient's examination clothing comprising:

a gown having a front, a back, an upper portion, and a lower portion;

a bib member being attached to said front and said upper portion of said gown;

an apron member being attached to said back and said lower portion of said gown; and a plurality of fastening members being attached to said gown and said bib member.

2. A patient's examination clothing as described in claim 1, wherein said gown also includes an upper back portion and an upper front portion being removably fastened to one another, each of said upper back and front portions including shoulder portions, sleeve portions and a neck portion.

3. A patient's examination clothing as described in claim 2, wherein said gown further includes an opening disposed through said upper front portion and through a top edge thereof, and also includes an opening disposed through said lower back portion and through a bottom edge thereof.

4. A patient's examination clothing as described in claim 3, wherein said bib member includes a bottom edge which is securely attached along a bottom edge defining said opening disposed through said upper front portion of said gown, and also includes side edge portions which removably overlap side edge portions defining said opening disposed through said upper front portion of said gown.

5. A patient's examination clothing as described in claim 4, wherein said bib member further includes a top edge having a recessed portion centrally disposed in said top edge thereof, said recessed portion being adapted to accommodate a user's neck.

6. A patient's examination clothing as described in claim 5, wherein said apron member includes a top edge which is securely attached along a top edge defining said opening disposed through said lower back portion of said gown, and also includes side edge portions which removably overlap side edge portions defining said opening disposed through said lower back portion of said gown.

7. A patient's examination clothing as described in claim 6, wherein said top edge of said apron member is securely attached at a waist line of said gown.

8. A patient's examination clothing as described in claim 7, wherein said fastening members include first fastening members which are securely disposed along edges of said sleeve portions and said shoulder portions of said upper front and back portions for securely and removably fastening respective said sleeve portions together and respective said shoulder portions together.

9. A patient's examination clothing as described in claim 8, wherein said fastening members also include second fastening members which are securely disposed along said side edge portions defining said opening disposed through said upper front portion of said gown, and which are securely disposed along said side edge portions of a back of said bib member.

10. A patient's examination clothing as described in claim 9, wherein said gown is adapted to extend below a user's crotch and buttock.

11. A patient's examination clothing comprising:

a gown having a front, a back, an upper portion, and a lower portion, said gown also including an upper back portion and an upper front portion being removably fastened to one another, each of said upper back and front portions including shoulder portions, sleeve portions and a neck portion, said gown further including an opening disposed through said upper front portion and through a top edge thereof, and also including an opening disposed through said lower back portion and through a bottom edge thereof, said gown being adapted to extend below a user's crotch and buttock, said gown having a length of approximately 39 inches;

a bib member being attached to said front and said upper portion of said gown, said bib member including a bottom edge which is securely attached along a bottom edge defining said opening disposed through said upper front portion of said gown, and also including side edge portions which removably overlap side edge portions defining said opening disposed through said upper front portion of said gown, said bib member further including a top edge having a recessed portion centrally disposed in said top edge thereof, said recessed portion being adapted to accommodate a user's neck;

an apron member being attached to said back and said lower portion of said gown, said apron member including a top edge which is securely attached along a top edge defining said opening disposed through said lower back portion of said gown, and also including side edge portions which removably overlap side edge portions defining said opening disposed through said lower back portion of said gown, said top edge of said apron member being securely attached at a waist line of said gown; and a plurality of fastening members being attached to said gown and said bib member, said fastening members including first fastening members which are securely disposed along edges of said sleeve portions and said shoulder portions of said upper front and back portions for securely and removably fastening respective said sleeve portions together and respective said shoulder portions together, said fastening members also including second fastening members which are securely disposed along said side edge portions defining said opening disposed through said upper front portion of said gown, and which are securely disposed along said side edge portions of a back of said bib member.

* * * * *